US006425786B1

(12) United States Patent
Scholler

(10) Patent No.: US 6,425,786 B1
(45) Date of Patent: Jul. 30, 2002

(54) CONTACT SOCKET FOR ELECTRICAL PIN-AND-SOCKET CONNECTOR

(75) Inventor: Johann Scholler, Deggendorf (DE)

(73) Assignee: Interconnectron GmbH, Deggendorf (DE)

( * ) Notice: Subject to any disclaimer, the term of this patent is extended or adjusted under 35 U.S.C. 154(b) by 0 days.

(21) Appl. No.: 09/614,315

(22) Filed: Jul. 12, 2000

(30) Foreign Application Priority Data

Jul. 15, 1999 (DE) ..... 199 33 091

(51) Int. Cl.[7] ..... H01R 13/187
(52) U.S. Cl. ..... 439/843; 439/851
(58) Field of Search ..... 439/843, 851, 439/825, 347, 357

(56) References Cited

U.S. PATENT DOCUMENTS 4,128,293 A * 12/1978 Paoli ..... 439/843
4,343,384 A * 8/1982 Mutter ..... 191/22 R
4,973,272 A * 11/1990 Chase et al. ..... 439/851
5,474,479 A * 12/1995 Bennett et al. ..... 439/843
5,810,627 A * 9/1998 Gierut et al. ..... 439/843
5,921,822 A * 7/1999 Kennedy et al. ..... 439/851
6,062,919 A * 5/2000 Trafton ..... 439/843

* cited by examiner

*Primary Examiner*—P. Austin Bradley
*Assistant Examiner*—Larisa Tsukerman
(74) *Attorney, Agent, or Firm*—Sidley Austin Brown & Wood, LLP

(57) ABSTRACT

For a readily manufactured configuration of contact plugs for electrical plug connectors, which consists of a stable sleeve body, formed from a sheet material, and a contact spring plug, lying in this sleeve body and having a plurality of contacting means, such as contacting wires or contacting strips in linear or strip-shaped contact with a contact pin, which is to be introduced into the plug, it is proposed that the sleeve body be provided with at least one projection, which is directed transversely to the longitudinal axis of the contact plug and formed by at least one stamping and is in positive engagement with one of the two edge strips of sheet material, connecting the contact wires or contact strips of the contact spring plug with one another.

3 Claims, 5 Drawing Sheets

CONTACT SOCKET FOR ELECTRICAL PIN-AND-SOCKET CONNECTOR

FIELD OF INVENTION

The invention relates to a contact socket for an electrical pin-and-socket connector and which consists of a stable sleeve body, formed from sheet material, and a contact spring plug, located in this sleeve body and having a plurality of contacting means, such as contacting wires or contacting strips for forming a linear or strip-shaped contact with a contact pin, which is to be introduced into the plug, with the contact wires or contact strips of the contact spring plug being aligned twisted around the axis of the plug and connected at both ends with an edge strip of sheet metal, and with the contact spring plug being connected mechanically and electrically with the sleeve body.

DESCRIPTION OF THE PRIOR ART

Such contact plugs, frequently also referred to as wire spring plugs or laminar spring contact plugs, are known and are distinguished, on the one hand, by exceptionally outstanding contacting properties and, on the other, by the fact that they can be manufactured economically.

A first known construction of such a contact plug is characterized in that the contact spring plug has a number of contact strips, which are aligned, on the whole, obliquely to the longitudinal axis of the contact spring plug. Characteristic for contact plugs of this configuration is the fact that the contact spring plugs have a number of strip-shaped contacting means, which are formed from a number of contact strips, which are punched out from a continuous strip of a contact material and, at the upper and lower ends of the contact spring plug, remain connected with one another over edge strips. In connection with the use of strip-shaped contacting means, cut free from a contact material, it is furthermore known that the blanks, punched out from a continuous strip of material and rolled into a contact spring plug or a contacting lining of a stable sleeve body, can be cut to length from continuous strips of material along oblique cutting lines, and the two cut edges of the blank, forming the contact spring plug, can be connected with one another along a connecting line directed obliquely to the axis of the plug, in order to achieve an arrangement of the strip-shaped contact, which are aligned obliquely to the axis of the plug and twisted about the axis of the plug.

All such contact plugs for electrical pin-and-socket connectors have a certain disadvantage in that it is relatively expensive to connect the comparatively labile contact spring plug with a stable sleeve body into a usable contact socket, without disadvantageously affecting the contacting properties of the contact spring plug.

It is therefore an object of the invention to provide a contact socket of the above-described construction for electrical pin-and-socket connectors, which can be produced at a reasonable price and, on the one hand, ensures a secure anchoring of the contact spring plug in the stable sleeve body and, on the other hand, can also easily produce in mechanical serial production.

SUMMARY OF THE INVENTION

The object of the invention is achieved by providing a sleeve body having at least one free-cut element which extends transversely to the longitudinal axis of the contact plug, is formed by stamping, and positively engages with one of the two edge strips of sheet metal which connect the contact wires or contact strips of the contact spring plug with one another.

The inventive, strictly positive mode of connecting the contact spring plug and the stable sleeve body is distinguished, first, by the advantage that a reliable contact connection is formed and, nevertheless, all heat-dependent methods such as welding or soldering and the like, for mutually connecting the contact spring plug and the stable sleeve part can be dispensed with so that heat distortion or similar undesirable phenomena cannot occur. Furthermore, the strictly mechanical positive fixing of the contact spring plug in the stable sleeve body permits the contact plug, as a whole, to be manufactured by simply using cutting and molding tools exclusively. This favors the manufacture of contact plugs from continuous strips of material by punching out, with a stamping and/or cutting tool, one-part contact spring plugs from a continuous strip of material with a crimping part for connecting the contact plug to a strand to be subsequently rolled regionwise more or less completely in such a manner, that the regions of the free-cut elements forming the contact spring plugs, can be rolled into a cylinder body, and the regions of the free-cut elements, forming the crimp parts, can only be bent, for example, into a U-shaped cross section. The contact spring plugs, so pre-manufactured, are then connected, notwithstanding the retention of their connection with a transport strip, in a mechanically producible, positive manner, by mutually connecting claws and teeth of the full-cut elements and abutments of the stable sleeve bodies pre-manufactured by cutting sheet material to length and rolling it up so that a usable contact sleeve is obtained. The free-cut elements preferably, but not exclusively, are formed into the stable sleeve body, forming the contact spring plug. Of course, the reverse arrangement of this alternating arrangement of the free-cut elements and abutments also falls within the range of the present invention.

In a first embodiment of a contact plug, consisting of a contact spring plug and a stable sleeve body, the contacting means of the contact spring plug consists of a contact strip sequence stamped out of a continuous strip material and connected with one another at both ends over edge strips of the continuous strip material and held at constant mutual distances. Furthermore, the sleeve body has two free-cut elements spaced from one another in the axial direction and each of which is in positive engagement with one of the two edge strips, connecting the contact strips at both ends with one another. In particular, further provisions can be made so that the free-cut elements of the sleeve body, directed radially to the longitudinal axis, are formed by reed-shaped, inwardly directed, elements and, in each case, engage in a gap between adjacent contact strips of the contact spring plug, and positively engaging at the inner edge of the edge strip connecting the contact strips at both ends with one another.

In accordance with a second embodiment of a contact plug, consisting of a contact spring plug and a stable sleeve body, provisions can, however, also be made so that at least one of the two edge strips, connecting the contact strips of the contact spring plug at both ends with one another, is provided with a window recess, and the sleeve body has at least one reed, which is stamped out and is in positive engagement with the window recess.

The window recess advantageously is disposed in the edge strip opposite the free end of the contact plug and is aligned in the circumferential direction of the contact spring plug, so that the positive connection between the contact spring plug and the stable sleeve body is shifted towards the region of the connection between the contact plug and the strand.

An advantageous configuration of the positive connection between the contact spring plug and the stable sleeve body consists in that the window recess, which is formed between the edge strip of the contact spring plug opposite the free end of the contact plug, has a rectangular shape, and that two mutually opposite and inwardly inclined reeds, which are engaged positively with the narrow sides of the window recess, are stamped out in the sleeve body. This construction is advantageous particularly in the case where provisions furthermore are made that the two reeds, cut out in the sleeve body, are aligned pointing towards one another, and each of the two reeds is stamped out running out into one of the two longitudinal edges of the sheet material blank forming the sleeve body.

BRIEF DESCRIPTION OF THE DRAWINGS:

In a further advantageous configuration, it is proposed that the butt edges of the material blank, forming the contact spring plug, and of the material blank, forming the sleeve body, are disposed mutually twisted by at least 45° to one another.

The invention is described in detail with reference to two examples shown in the drawing, in which.

DETAILS OF THE PREFERRED EMBODIMENTS

Figure 1:
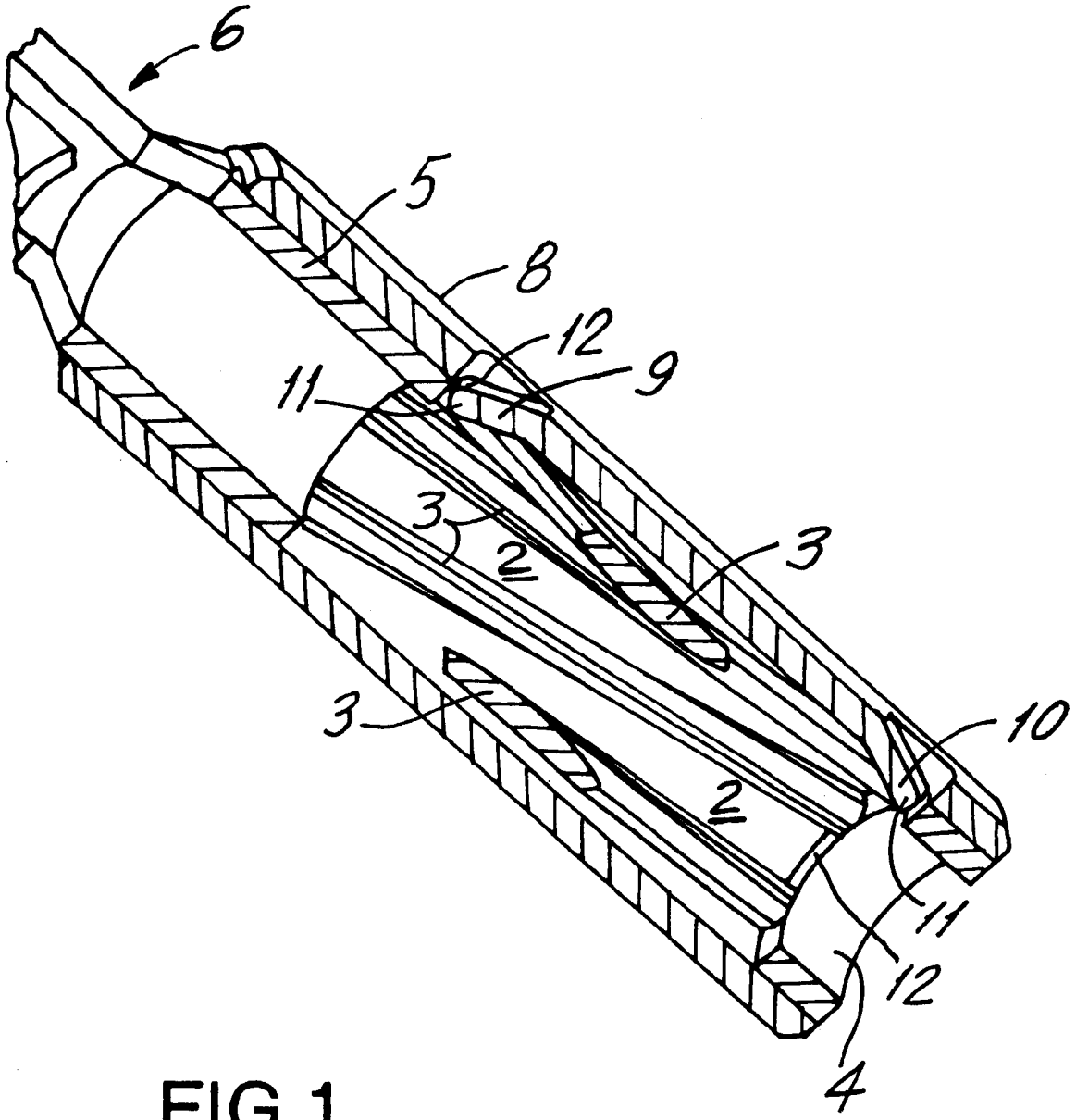
FIG. 1 shows a partially cross-sectional diagrammatic review of a first embodiment of a contact plug, FIG. 2 a perspective view of a second embodiment of a contact plug.
Figure 2:
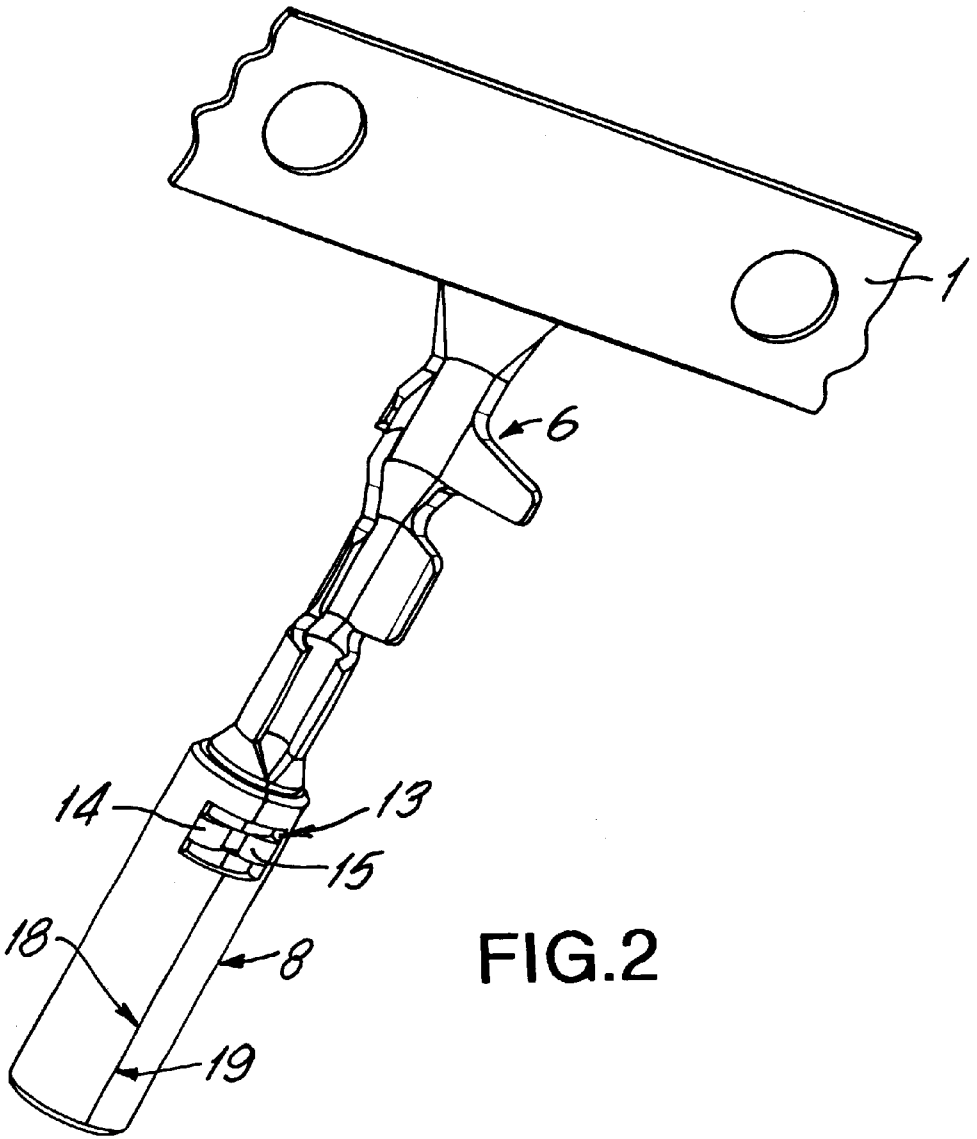
Figure 3:
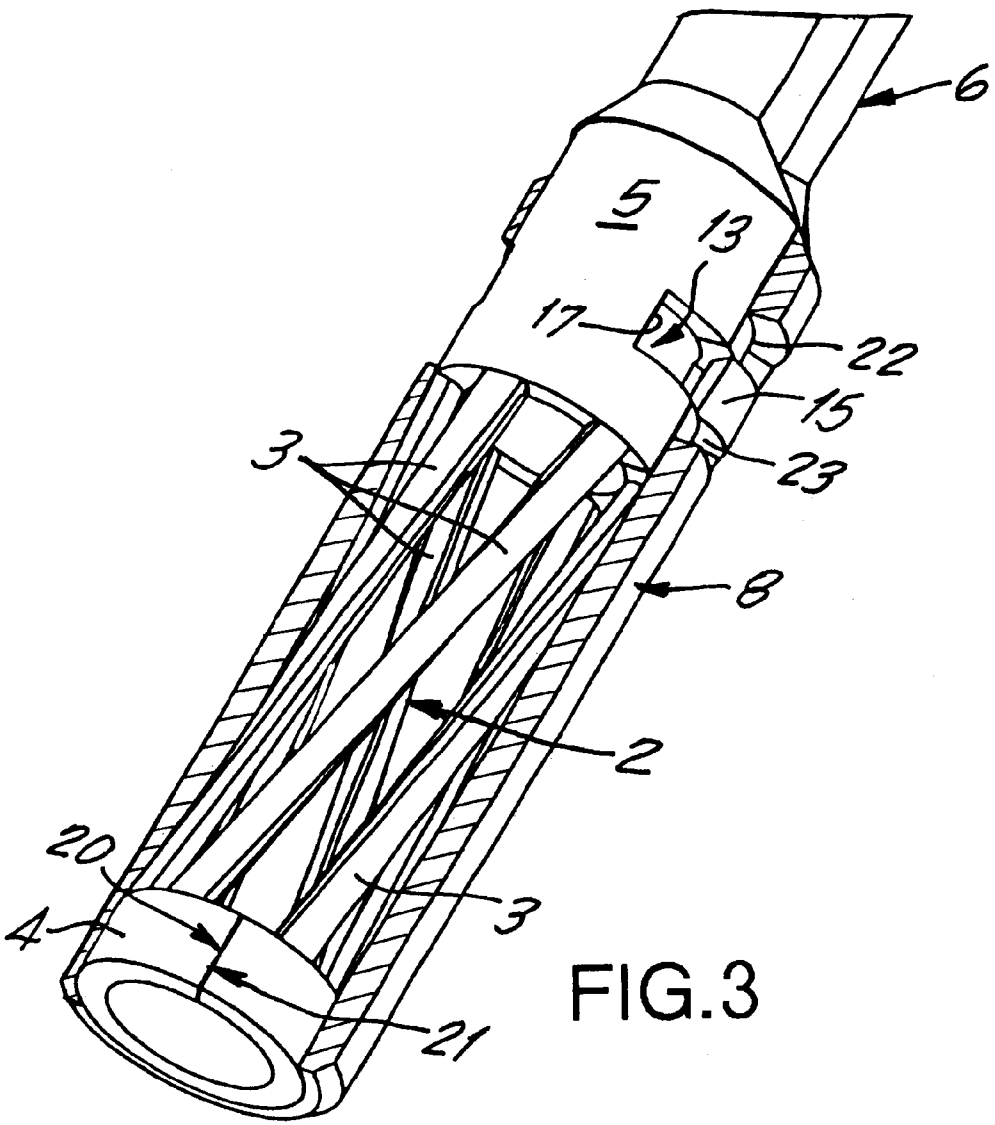
FIG. 3 shows a partially cross-sectional view of the contact plug shown in FIG. 2.
Figure 4:
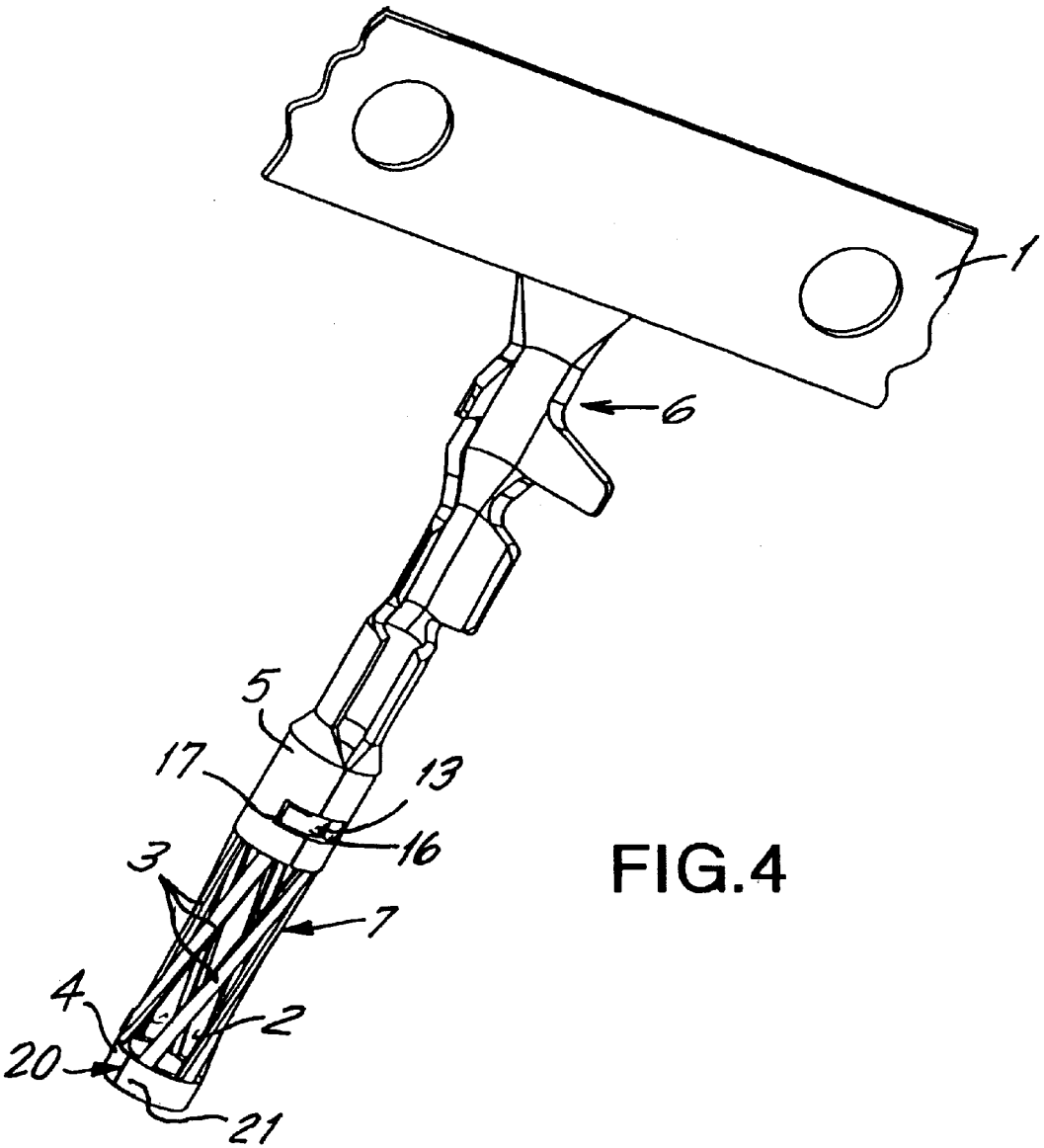
FIG. 4 shows a perspective view of a contact spring plug with an integrally molded crimp part.
Figure 5:
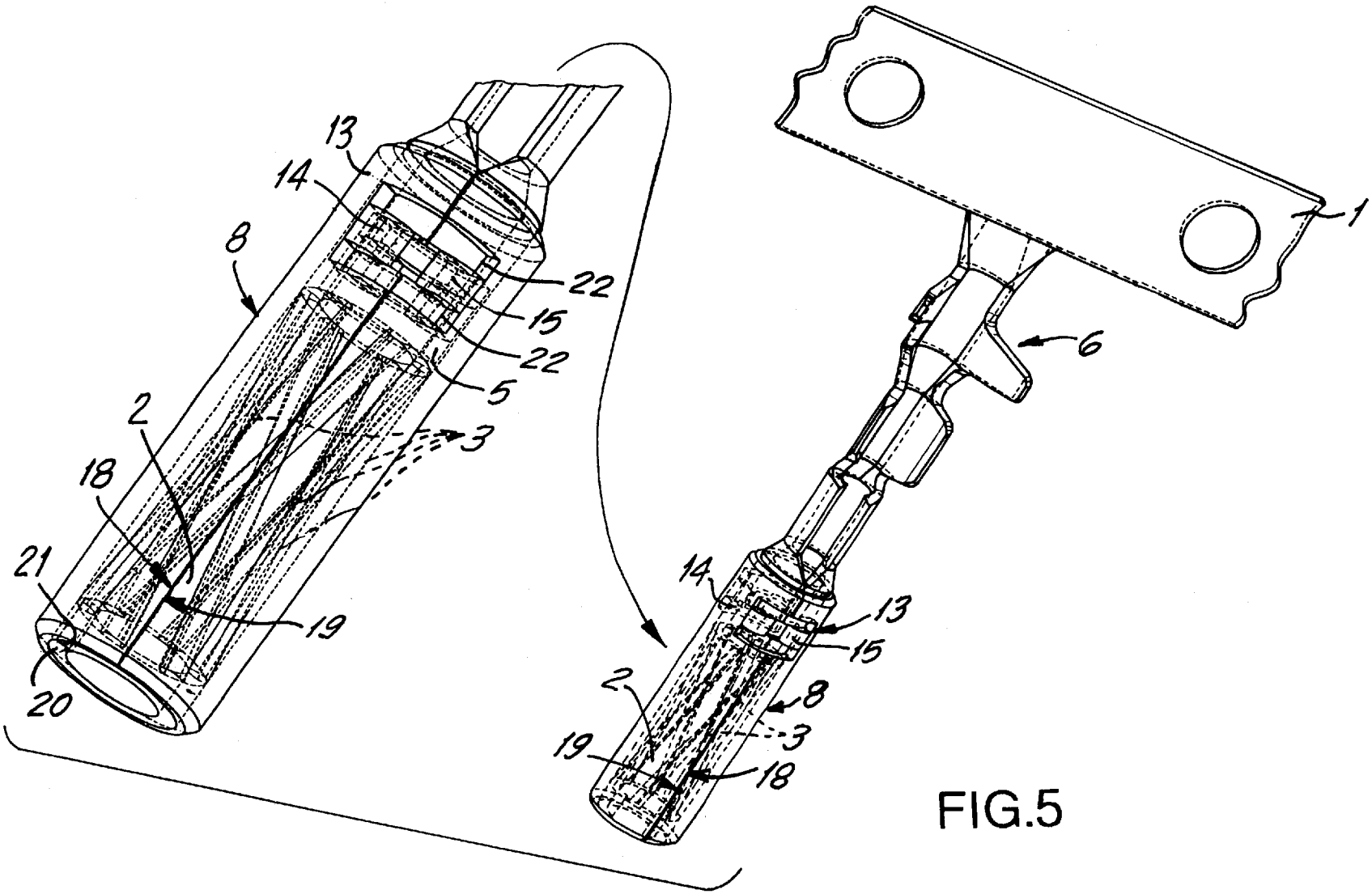
FIG. 5 shows a perspective view of the position of a contact spring plug in a stable sleeve body.

In all embodiments of a contact spring plug for electrical pin-and-socket connectors shown in FIGS. 1 to 5, a plurality of free-cut windows 2 have been stamped out from a strip 1 formed of an electrically conducting sheet material and having originally a smooth surface in such a manner that, in the embodiment shown, between the windows 2, contacting means 3 are retained, which have a rectangular cross-sectional shape and, moreover, remain connected with one another at both ends over a respective edge strip 4 or 5. Together with the contacting means 3, a crimp connection 6 is at the same time also punched out of the strip 1. The cut-to-size regions of one-part crimping connectors 6, formed integrally with the cut-to-size regions forming the contact spring plug 7, remain constantly connected as a whole and with a region of the starting material, forming a transporting strip. In both embodiments shown, the contact spring plug 7 is form-lockingly received in a stable sleeve body 8 which, in turn, is formed by a flat section of material rolled into a cylindrical body. According to the embodiment shown in FIG. 1, the stable sleeve body 8 is provided with two free-cut elements aligned opposite to one another, which are pushed through towards the center of the sleeve body 8 and form reeds 9 and 10. With their free ends 11, the reeds 9 and 10 in each case lie against the inner end surface 12 of the edge strip 4 or 5 and, in this way, form a stable axial and radial support for the contact spring plug 7 in the stable sleeve body 8.

In the case of the embodiment shown in FIGS. 2 to 5, the edge strips 4 and 5, which connect the contacting means 3 with one another, from their one free end of the contact spring plug 7 to the other end of the contact spring plug 7 adjacent to the crimp connection 6, are formed with a different width and, moreover, in such a manner, that the edge strip 5, adjacent to the crimp connection 6, has a larger axial extent than does the edge strip 4, facing the free end of the contact plug. As it can be seen particularly clearly in FIG. 4, a window recess 13, having a rectangular profile and aligned in the circumferential direction of the edge strip 4, is cut open in the edge strip 4. Complementary to the window recess 13, two reeds 14 and 15, which are also aligned in the circumferential direction, disposed opposite to one another and point towards one another with their free ends, are cut free in the stable sleeve body 8 and are bent inward with respect to the contact sleeve in such a manner that they positively engage the narrow edges 16 and 17 of the window recess 13. In the embodiment shown, the two reeds 14 and 15 are cut free in one of the two longitudinal edges 18 or 19 of the sheet material blank forming the sleeve body 8. Furthermore, as it can also be seen from the view of FIG. 5, the butt edges 20 and 21 of the material blank, forming the contact spring plug 7, and the butt edges 18 or 19 of the material blank, forming the sleeve body 8, are twisted relative to one another by at least 45°. Moreover, it can be seen particularly clearly, especially from FIGS. 2 and 3, that the reeds 14 and 15 of the stable sleeve body 8, arranged externally of the two longitudinal edges 18 and 19, are cut along their two longitudinal sides in each case with a wide relief space 22, 23, thus ensuring a convenient tool catch.

What is claimed is:

1. A contact socket for an electrical pin-and-socket connector, comprising a stable sleeve body formed of a sheet material, and a contact spring plug located in the sleeve body and having contact means consisted of a plurality of one of contact wires and contact strips for contacting a contact pin to-be-introduced into the spring plug, the one of contact wires and contact strips being aligned twisted about a spring plug axis and connected at opposite ends thereof by respective edge strips formed of a sheet material, wherein the contact means consist of a plurality of contact strips formed as a contact strip sequence punched out of a continuous strip material and held at mutually constant distances from one another, wherein at least one of the edge strips, which is rolled into a cylindrical body, has a window recess, wherein the sleeve body has at least one inwardly bent, reed-shaped, free-cut element extending transverse to the spring plug axis and having an end surface positively engaging the window recess of the at least one edge strip, and wherein the sleeve body has a further inwardly bent, free-cut reed-shaped element extending transverse to the spring plug axis, and having an end surface positively engaging the window recess of the at least one edge strip.

2. A contact socket according to claim 1, wherein the window recess has a rectangular shape in a plan view, and wherein the at least one and another reed-shaped, free-cut elements are circumferentially aligned with each other, facing each other, and engage opposite narrow sides of the window recess.

3. A contact socket according to claim 1, wherein the at least one and another reed-shaped, free-cut elements are cut free in respective opposite longitudinal edges of a sheet material blank, which is rolled into the sleeve body, so that upon the sheet material blank being rolled into the sleeve body, both reed-shaped, free-cut elements are aligned with each other, facing each other.

* * * * *